US007891599B2

(12) United States Patent
Kishimoto et al.

(10) Patent No.: US 7,891,599 B2
(45) Date of Patent: Feb. 22, 2011

(54) TAKE-UP REEL FOR METALLIC FILAMENT

(75) Inventors: Kazuhiro Kishimoto, Hyogo (JP); Akio Kataoka, Hyogo (JP)

(73) Assignee: Tokusen Kogyo Co., Ltd., Hyogo (JP)

( * ) Notice: Subject to any disclaimer, the term of this patent is extended or adjusted under 35 U.S.C. 154(b) by 92 days.

(21) Appl. No.: 11/995,681

(22) PCT Filed: Jul. 12, 2006

(86) PCT No.: PCT/JP2006/313860

§ 371 (c)(1),
(2), (4) Date: Jan. 14, 2008

(87) PCT Pub. No.: WO2007/007785

PCT Pub. Date: Jan. 18, 2007

(65) Prior Publication Data

US 2009/0121070 A1 May 14, 2009

(30) Foreign Application Priority Data

Jul. 13, 2005 (JP) ..... 2005-204052

(51) Int. Cl.
*B65H 75/28* (2006.01)

(52) U.S. Cl. ..... 242/580; 242/586.6; 242/125.2

(58) Field of Classification Search ..... 242/579, 242/580, 586.4, 586.5, 586.6, 475.7, 475.8, 242/476.1, 476.6, 125–125.3, 586, 586.2
See application file for complete search history.

(56) References Cited

U.S. PATENT DOCUMENTS 5,549,257 A * 8/1996 Sanda et al. ..... 242/580
5,586,733 A * 12/1996 Miura et al. ..... 242/125.2
5,931,408 A 8/1999 Ishii et al.

FOREIGN PATENT DOCUMENTS

| | | | |
|---|---|---|---|
| CN | 1206683 | A | 2/1999 |
| JP | S50-3510 | | 1/1975 |
| JP | 06-107377 | A | 4/1994 |
| JP | 3004340 | U | 9/1994 |
| JP | 09-263360 | A | 10/1997 |

* cited by examiner

*Primary Examiner*—William E Dondero
(74) *Attorney, Agent, or Firm*—Browdy and Neimark, PLLC

(57) ABSTRACT

To secure the end part of a metallic filament taken up onto a reel, the take-up reel for metallic filament has a recessed portion (3) provided in the inside surface of a flange (2), the recessed portion (3) extending in the radial direction to the flange outer edge (2*a*); and a connecting portion (4) that straddles the recessed portion (3). A tabular end retaining member (5) having elasticity is fitted into the recessed portion 3. The base end portion (5*b*) of the end retaining member (5) is passed under the connecting portion (4) and butted up against the end surface (3*a*) of the recessed portion (3) on the winding drum side, and a space (A) is provided between the tip end portion (5*a*) of the end retaining member (5) and the flange outer edge (2*a*) to allow the end part of the metallic filament (W) to be caught therein. The end retaining member (5) is anchored to the connecting portion (4) through spot welding, using a welding portion (6) set in the vicinity of the base end portion.

6 Claims, 1 Drawing Sheet

TAKE-UP REEL FOR METALLIC FILAMENT

TECHNICAL FIELD

The present invention relates to a reel for taking up a metallic filament such as steel wire, steel cord, wire rope, electrical wire, and the like, and particularly relates to a reel structure for securing an end part of the metallic filament that has been wound up onto the reel.

BACKGROUND ART

In a take-up reel for metallic filament provided with a flange on both sides of the winding drum, the following can be given as a general example of a conventional structure for securing the end part of the metallic filament when the metallic filament is fully wound up on the reel. A small hole is provided in the outer circumference of the flange, and an end retaining member composed of steel wire, a plate spring, or the like is provided on the surface of the outer circumference of the flange in the vicinity of the small hole. The end part of the metallic filament is led through the small hole and is then sandwiched between the end retaining member and the outer surface of the flange. However, in such a case, the operation for passing the end part of the metallic filament through the small hole is troublesome, as is the operation for removing the end part when releasing the metallic filament. In particular, with steel cord used in tires, steel cord is typically unwound from more than 500 reels during the rubber coating process (calendaring process), one of the intermediate processes in tire manufacturing; it takes an inordinate amount of time to release the end parts of the steel cord from the end retaining members of such a large number of reels. Furthermore, if the metallic filament is a stranded wire such as steel cord or wire rope, there is a problem in that the end part frays and becomes difficult to pass through the small hole; for this reason, it is necessary to wind the end part in tape or weld the strands to one another through fusion in advance, which has been a very complicated process.

In order to solve the abovementioned problems, there has been proposed a reel onto which is attached an end retaining member capable of protruding from and receding into an access hole formed in a flange, the end retaining member having a catcher for retaining the end of the metallic filament at the tip thereof (see, for example, Patent Document 1).

This reel causes the end retaining member to elastically change in shape by applying pressure on the end retaining member in the outside-to-inside direction of the outer end surface of the flange, pushing only the catcher into the access hole; after the end part of the metallic filament is engaged with the catcher, the pressure is released, trapping the end of the metallic filament. With this kind of reel, the end part of the metallic filament does not need to be passed through a small hole, which eliminates the trouble of removing the end part from the small hole at the time of releasing, leading to an improvement in operational efficiency. However, with this type of reel, the end retaining member attached to the outer end surface of the flange protrudes significantly from the outer surface of the flange, which causes a problem in that the end part of the metallic filament dislodges from the end retaining member due to the end retaining member being pushed when the reel flange makes contact with another reel flange during the packaging and transport process for reel products, or when reels are stacked upon one another.

Accordingly, there has been proposed a reel in which a recessed portion is formed in the inner surface of the flange in a radial direction so as to extend to the flange outer edge, and a metallic filament end retaining member composed of a tabular metallic plate is provided so as to be embedded in the recessed portion; the end part of the metallic filament is grasped between the recessed portion of the flange and the end retaining member (see, for example, Patent Document 2).

However, with this type of reel, there is the possibility that the metallic filament enters into the space between the base end of the end retaining member and the bottom of the recessed portion, and becomes caught on the end retaining member at the time of releasing, causing problems such as breakage of the metallic filament.

Moreover, when retaining the end part of the metallic filament, the end retaining member enters a bent state, with its point of support being the portion of the end retaining member that is anchored to the end retaining member base end portion; this concentrates stress on this anchored portion, which generally uses spot welds and thus has decreased strength and tenacity due to the influence of heat. For this reason, problems such as plastic deformation, or, in a worst-case scenario, the end retaining member itself breaking, have arisen due to the bending of the end retaining member.

Further still, as stated above, spot welds are generally used for the anchored portion due to a strong anchoring force being required; however, with spot welding, the vicinity of the spot welds are annealed by the heat of the welding, causing a problem in that the amount of pressure that presses the end part of the metallic filament in the direction of the recessed portion in the flange drops, which in turn makes it impossible to retain the end part of the metallic filament with certainty.

Generally speaking, reels for taking up metallic filament such as steel wire, steel cord, wire rope, electrical wire, and the like are not single-use, disposable items, but rather can be repeatedly used any number of times, and thus the abovementioned problems present a major drawback in that they significantly shorten the lifespan of the reel.

As a solution for these conventional problems, there has been proposed a take-up reel for metallic filament in which a recessed portion is formed in the inner side of the flange in a radial direction so as to extend to the flange outer edge, the recessed portion having an attachment hole at its base; a tabular end retaining member having elasticity is fitted into the recessed portion, and the end retaining member base end portion is butted against the outer side surface of the flange and anchored (see, for example, Patent Document 3).

With this type of reel, the end retaining member base end portion that anchors the end retaining member extends to the outer periphery of the flange from the attachment hole in the base of the recessed portion, the recessed portion being provided in the radial direction extending to the flange outer edge; therefore, there is no space between the end retaining member base end portion and the recessed portion, which eliminates the conventional problem where the metallic filament enters thereinto at the time of releasing.

Furthermore, with this type of reel, when metallic filament has been fully wound upon the reel, the end part of the metallic filament is grasped between the end retaining member and the flange, with the end part of the metallic filament being secured by pressure arising from the elasticity of the end retaining member. Here, the force acting on the end retaining member has the portion where the attachment hole and the end retaining member make contact with one another as its point of support, meaning that the end retaining member is in a state where it is bent central to this portion. Thus, even if the elastic region drops due to the influence of heat in the vicinity of the end retaining member base end portion during spot welding, the pressure in the direction that presses the end part of the metallic filament does not decrease, making it possible to retain the end part of the metallic filament with certainty.

Further still, with this type of reel, the end retaining member is bent with the portion where the attachment hole and the end retaining member make contact with one another as the point of support, making it possible to avoid concentrating stress on the anchored portion; this in turn makes it possible to prevent plastic deformation, and reduces the possibility of the end retaining member dislodging due to breakage. Hence, the reel can be used repeatedly. Moreover, at the time of releasing, the metallic filament can be released simply by firmly pulling the end part of the metallic filament in an upward direction.

[Patent Document 1] JP H6-107377A

[Patent Document 2] Japanese Application for Utility Model Registration No. 3004340

[Patent Document 3] JP H9-263360A

DISCLOSURE OF THE INVENTION

Problem to be Solved by the Invention

In the abovementioned conventional take-up reel for metallic filament, a recessed portion is formed in the inner side of the flange in a radial direction so as to extend to the flange outer edge, the recessed portion having an attachment hole at its base, and a tabular end retaining member having elasticity is fitted into the recessed portion, the end retaining member base end portion being butted against the outer side surface of the flange and anchored. In such a reel, there is no space between the end retaining member base end portion and the recessed portion, and thus the metallic filament does not enter thereinto at the time of releasing; furthermore, the end retaining member is bent with the portion where the attachment hole and the end retaining member make contact with one another as the point of support, which reduces a degradation in pressure caused by the influence of heat at the time of anchoring and thus makes it possible to retain the end part of the metallic filament with certainty. Furthermore, with such a reel, it is possible to avoid concentrating stress on the anchored portion, making it possible to prevent plastic deformation, reduce the possibility of the end retaining member dislodging due to breakage, and reuse the reel repeatedly. Finally, with this reel, releasing is easy. However, this reel also has problems.

That is, with the abovementioned conventional reel, the end retaining member base end portion extends out of the access hole and is anchored to the outside surface of the flange; however, positioning at this time is difficult. It is necessary for the end retaining member in the abovementioned conventional reel to be accurately placed and anchored in a position that allows for a predetermined amount of space between the tip thereof and the outside surface of the flange, and if the positioning is not correct, it becomes difficult to grasp the end part of the metallic filament between the end retaining member and the flange, which also makes releasing difficult.

Furthermore, with the end retaining member in the abovementioned conventional reel, the end retaining member base end portion is only anchored to the outside surface of the flange. Therefore, although concentration of stress on the anchored portion can be avoided, plastic deformation can be prevented, and the possibility of the end retaining member dislodging due to breakage can be reduced by the end retaining member being bent with the portion where the attachment hole and the end retaining member make contact with one another as the point of support, this effect is limited, and it is necessary to prevent dislodging in a stronger manner.

Having been conceived as a solution to such problems, it is an object of the present invention to provide a take-up reel for metallic filament in which the end part of metallic filament can be easily retained and released by an end retaining member; problems at the time of releasing can be eliminated; the end part of the metallic filament can be retained with certainty, and positioning when anchoring the end retaining member can be performed with ease; dislodging of the end retaining member can be prevented in a stronger manner; and the lifespan of a reusable reel can be greatly extended.

Means to Solve the Problems

A take-up reel for metallic filament according to the present invention has a flange at both ends of a winding drum, and comprises: a recessed portion in at least one area in the inside surface of a flange, the recessed portion extending in the radial direction to the flange outer edge; and a connecting portion that straddles the recessed portion in the circumferential direction partway along the recessed portion, thereby connecting the inside surface of the flange on both sides of the recessed portion, wherein a tabular end retaining member having elasticity is fitted into the recessed portion, with the base end portion of the end retaining member being passed under the connecting portion and butted up against the end surface of the recessed portion on the winding drum side, and with enough space provided between the tip end portion of the end retaining member and the flange outer edge to allow the end part of the metallic filament to be caught therein, and the area around the base end portion is anchored to the connecting portion.

With this reel, the end part of the metallic filament does not need to be passed through a small hole, nor does the end part need to be wound in tape or the strands thereof welded to one another through fusion; this simplifies the processes for retaining and releasing the end part. Furthermore, the base end portion of the end retaining member is passed under the connecting portion and butted up against the end surface of the recessed portion on the winding drum side, and the area around the base end portion is anchored to the connecting portion; accordingly, a space between the base end portion of the end retaining member and the recessed portion, into which the metallic filament can enter, is not present, solving the problem in which the metallic filament enters thereinto at the time of releasing.

Moreover, with this reel, the base end portion of the end retaining member is passed under the connecting portion and butted up against the end surface of the recessed portion on the winding drum side, and the area around the base end portion is anchored to the connecting portion, making positioning at the time of anchoring the end retaining member easy to carry out.

Furthermore, with this type of reel, when metallic filament has been fully wound, the end part of the metallic filament is grasped between the end retaining member and the flange, and as a result, the end part of the metallic filament is secured by pressure arising from the elasticity of the end retaining member. Here, the end retaining member is bent with the portion where the connecting portion and the end retaining member make contact with one another as its point of support. Thus, even if the elastic region drops due to, for example, the influence of heat in the vicinity of the end retaining member base end portion during spot welding, the pressure in the direction that presses the end part of the metallic filament does not decrease, making it possible to retain the end part of the metallic filament with certainty.

Moreover, the end retaining member of this reel is bent with the portion where the connecting portion and the end retaining member make contact with one another as its point of support, in a state in which the end portion of the end retaining member presses upon and is anchored to the inner surface of the recessed portion. This makes it possible to avoid concentrating stress upon the anchored portion, thereby preventing plastic deformation, breaks, and the like; if, however, there is a break, the end portion of the end retaining member is held by the recessed portion and the connecting portion, and thus the end retaining member does not immediately come off of the reel, making recovery easy and extending the lifespan of reusable reels. Also, at the time of releasing, the metallic filament can be released simply by firmly pulling the end part of the metallic filament in the external radial direction.

Moreover, in this reel, it is preferable for the tip end portion of the end retaining member to be slightly bent outwardly along the flange outer edge. Slightly bending the tip end portion of the end retaining member outwardly along the flange outer edge ensures that the metallic filament does not rub against or become caught upon the end retaining member when it is taken up onto or let out from the reel.

It is also preferable for the end retaining member to be a metallic plate. However, the end retaining member can be formed of plastic.

It is furthermore preferable for the corners on the tip end of the end retaining member have been rounded off through beveling. Such beveling makes it easy to catch the metallic filament.

Effects of the Invention

As has been made clear by the foregoing descriptions, the take-up reel for metallic filament according to the present invention has the following remarkable effects: the end part of metallic filament can be easily retained and released by an end retaining member without the end part of the metallic filament needing to be passed through a small hole, nor the end part needing to be wound in tape or the strands thereof welded to one another through fusion; problems when unwinding can be eliminated; the end part of the metallic filament can be retained with certainty, and positioning when anchoring the end retaining member can be performed with ease; dislodging of the end retaining member can be prevented in a stronger manner; and the lifespan of a reusable reel can be greatly extended.

In particular, the base end portion of the end retaining member is passed under the connecting portion and butted up against the end surface of the recessed portion on the winding drum side, and the area around the base end portion is anchored to the connecting portion; accordingly, a space between the base end portion of the end retaining member and the recessed portion, into which the metallic filament can enter, is not present, solving the problem in which the metallic filament enters thereinto at the time of releasing.

Moreover, the base end portion of the end retaining member is passed under the connecting portion and butted up against the end surface of the recessed portion on the winding drum side, and the area around the base end portion is anchored to the connecting portion, making positioning at the time of anchoring the end retaining member easy to carry out.

Furthermore, the end retaining member that retains the end part of the metallic filament is bent with the portion where the connecting portion and the end retaining member make contact with one another as its point of support. Thus, even if the elastic region drops due to, for example, the influence of heat in the vicinity of the end retaining member base end portion during spot welding, the pressure in the direction that presses the end part of the metallic filament does not decrease, making it possible to retain the end part of the metallic filament with certainty.

Moreover, the end retaining member that retains the metallic filament is bent with the portion where the connecting portion and the end retaining member make contact with one another as its point of support, in a state in which the end portion of the end retaining member presses upon and is anchored to the inner surface of the recessed portion. This makes it possible to avoid concentrating stress upon the anchored portion, thereby preventing plastic deformation, breaks, and the like; if, however, there is a break, the end portion of the end retaining member is held by the recessed portion and the connecting portion, and thus the end retaining portion does not immediately come off of the reel, making recovery easy and greatly extending the lifespan of reusable reels.

BEST MODE FOR CARRYING OUT THE INVENTION

Hereinafter, an embodiment of the present invention shall be described with reference to the drawings.

Figure 1:
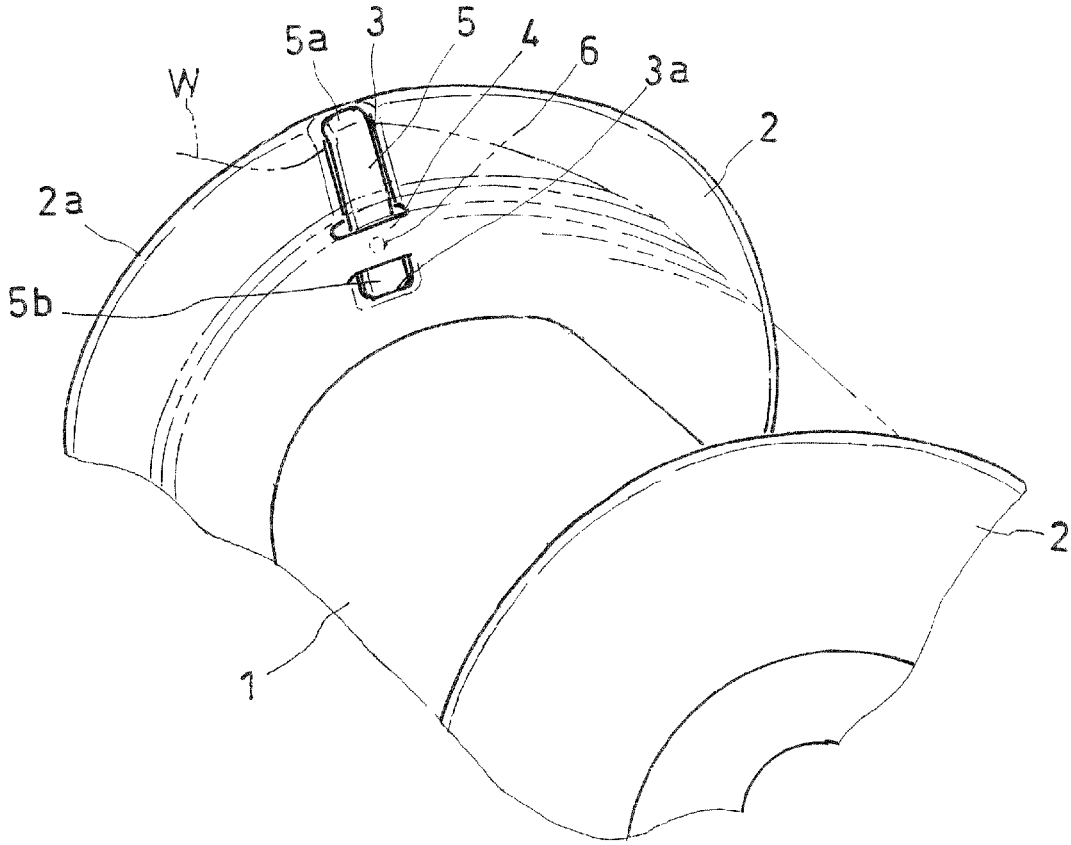
FIG. 1 is a schematic diagram illustrating a configuration of a reel for metallic filament according to an embodiment of the present invention.
Figure 2:
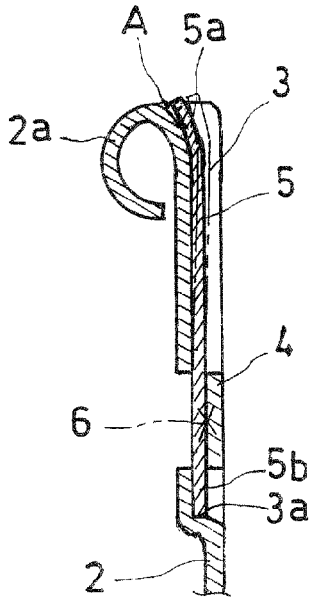
FIG. 2 is an enlarged cross-sectional view of an end retaining member of a reel for metallic filament according to an embodiment of the present invention.

FIG. 1 is a schematic diagram illustrating a configuration of a reel for metallic filament, whereas FIG. 2 is an enlarged cross-sectional view of an end retaining member of the reel for metallic filament, according to the embodiment of the present invention.

The take-up reel for metallic filament according to this embodiment has, as shown in FIG. 1, flanges 2 and 2 provided on both ends of a winding drum 1. A recessed portion 3 is provided in at least one area in the inside surface of the flanges 2 and 2, and extends in the radial direction to the flange outer edge 2*a*; and a connecting portion 4 is provided partway along the recessed portion 3, straddling the recessed portion 3 in the circumferential direction, thereby connecting the inside surface of the flange on both sides of the recessed portion 3, the connecting portion 4 being flush with the inside surface of the flange on both sides of the recessed portion 3. A tabular end retaining member 5, which is a metallic plate having elasticity, is fitted into the recessed portion 3; the tip end portion 5*a* of the end retaining member 5 is slightly bent outwardly along the flange outer edge 2*a*, and the corners of the tip end portion 5*a* are rounded off through beveling. The base end portion 5*b* of the end retaining member 5 is passed under the connecting portion 4 and butted up against the end surface 3*a* of the recessed portion 3 on the winding drum side, and a space A is provided between the tip end portion 5*a* of the end retaining member 5 and the flange outer edge 2*a* to allow the end part of the metallic filament W to be caught therein. In such a state, the end retaining member 5 is anchored to the connecting portion 4 through spot welding, using a welding portion 6 set in the vicinity of the base end portion.

In this example, a metallic plate is used as the tabular end retaining member 5 having elasticity; however, a material having elasticity, such as plastic or the like, may be used instead of metal.

Furthermore, the end retaining member 5 may processed as appropriate so as to take on a bumpy shape, a wave shape, or the like, so that the end part of the metallic filament W is caught thereby; the surface roughness of the end retaining member 5 may also be increased so as to increase the friction between the end retaining member 5 and the end part of the metallic filament W.

A steel cord having a so-called 1×7 construction, in which seven metallic strands 0.33 mm in diameter each are twisted together, was taken up using this reel. The overall diameter of this steel cord is 0.99 mm. When the end part of this cord is introduced through the space A and is drawn in the central direction of the reel, the end part is securely sandwiched between the end retaining member 5 and the flange 2. At this time, the end part of the metallic filament W is drawn into the space between the end retaining member 5 and the flange 2, and the end retaining member 5 is bent into a bow shape, as indicated by the dash-double-dot line in FIG. 2, to a degree that does not exceed the elastic region of the end retaining member 5, with the part where the connecting portion 4 and the end retaining member 5 make contact with one another being the point of support; force is exerted in the direction that presses down upon the end part of the metallic filament W. Furthermore, static friction arises between the end retaining member 5 and the end part of the metallic filament W, and between the end part of the metallic filament W and the flange 2. The end part of the metallic filament W is sandwiched due to these forces.

Next, it was confirmed that the metallic filament W can be released easily simply by strongly pulling the end part of the metallic filament W in the outer radial direction, from the state mentioned above. After the metallic filament has been released, the end retaining member 5 returns toward the flange 2 due to its elasticity, and returns to the form indicated by the solid line in FIG. 2.

If the space A between the tip end portion 5*a* of the end retaining member 5 and the flange outer edge 2*a* is too large, the tip part of the metallic filament W will be caught therein when the filament is taken up on the reel, and thus it is preferable for the size to be such that the tip end portion 5*a* is nearly touching the flange outer edge 2*a*, and the end part of the metallic filament W barely fits therein.

The invention claimed is:

1. A take-up reel for metallic filament having a flange at both ends of a winding drum, the reel comprising:

a recessed portion in at least one area in an inside surface of a flange, the recessed portion extending in a radial direction toward a flange outer edge; and a connecting portion that straddles the recessed portion in a circumferential direction extending only partway along the recessed portion, thereby connecting the inside surface of the flange on both sides of the recessed portion, wherein the connecting portion is flush with the inside surface of the flange on both sides of the recessed portion, and wherein a tabular end retaining member having elasticity is fitted into the recessed portion, with a base end portion of the end retaining member being passed under the connecting portion and brought into contact with an inside surface of the recessed portion on a side of the connecting portion closer to a winding drum side and out of the connecting portion and butted up against an end surface of the recessed portion on the winding drum side, and with enough space provided between a tip end portion of the end retaining member and the flange outer edge to allow an end part of the metallic filament to be caught therein, and an area around the base end portion is anchored to the connecting portion.

2. The take-up reel for metallic filament according to claim 1, wherein the tip end portion of the end retaining member is bent outwardly along the flange outer edge.

3. The take-up reel for metallic filament according to claim 1 or 2, wherein the end retaining member is a metallic plate.

4. The take-up reel for metallic filament according to claim 3, wherein corners on an end of the end retaining member have been rounded off through beveling.

5. The take-up reel for metallic filament according to claim 1 or 2, wherein corners on an end of the end retaining member have been rounded off through beveling.

6. The take-up reel for metallic filament according to claim 1, wherein said connecting portion has a radial extent less than one-half the length of the recessed portion in the radial direction.

* * * * *